United States Patent [19]

Fujikawa

[11] Patent Number: 5,060,380

[45] Date of Patent: Oct. 29, 1991

[54] HAIR CUTTER WITH COMB

[75] Inventor: Shoji Fujikawa, Ishibe, Japan

[73] Assignee: Matsushita Electric Works, Ltd., Osaka, Japan

[21] Appl. No.: 653,132

[22] Filed: Feb. 11, 1991

[30] Foreign Application Priority Data

Feb. 15, 1990 [JP] Japan ..... 2-34242

[51] Int. Cl.[5] ..... B26B 19/00

[52] U.S. Cl. ..... 30/200; 30/206; 30/233.5

[58] Field of Search ..... 30/200–202, 30/30, 34.03, 206, 216, 233, 233.5

[56] References Cited

U.S. PATENT DOCUMENTS

| | | | |
|---|---|---|---|
| 2,539,011 | 1/1951 | Democenzo | 30/200 X |
| 2,715,266 | 8/1955 | Haislip | 30/200 X |
| 4,614,036 | 9/1986 | Hamaguchi | 30/200 |
| 4,669,189 | 6/1987 | Ullmann | 30/200 |
| 4,825,546 | 5/1989 | Araki et al. . | |
| 4,888,870 | 12/1989 | Fujikawa et al. . | |

*Primary Examiner*—Douglas D. Watts

*Attorney, Agent, or Firm*—Stevens, Davis, Miller & Mosher

[57] ABSTRACT

A hair cutter has a housing with a part-cylindrical cutter head and a comb member. The cutter head comprises an outer shear plate having a number of perforations and an inner cutter assembly. The inner cutter assembly includes a rotary shaft carrying a plurality of radially oriented cutter blades in a circumferentially spaced relation about an axis of the rotary shaft. The outer shear plate is arcuately curved in transverse cross section to cover a portion of the curve centered on the rotary shaft axis so as to have its inside surface in hair shearing engagement with the cutter blades. The inner cutter assembly is driven by a drive source in the housing in such a manner that the cutter blades sweep the inside surface of the outer shear plate for shearing hairs introduced through the perforations. The comb member has a number of comb teeth which are spaced along the rotary shaft axis and extend over an perforated area of the outer shear plate for smoothing the hairs into the perforations. The comb teeth are configured to have tapered ends for facilitating the hair smoothing into the perforations.

3 Claims, 9 Drawing Sheets

HAIR CUTTER WITH COMB

BACKGROUND OF THE INVENTION

1. Field of the Invention

The present invention is directed to a hair cutter, and more particularly to an electric hair cutter designed for trimming long hairs with rotary cutter blades.

2. Description of the Prior Art

There have been generally utilized hair clippers for cutting long hairs as well as trimming the same. Such hair clippers are designed, as typically disclosed in U.S. Pat. No. 4,825,546, to have a flat stationary blade and a flat movable blade reciprocating on the stationary blade for cutting hairs between the toothed edges thereof. However, in order to effect neat trimming the hair clipper of this type requires a considerable degree of skill which can be acquired only after extended practice. To overcome the above insufficiency, there has proposed an improved hair cutter in U.S. Pat. No. 4,888,870 which facilities the hair trimming even by an unskilled user. The hair cutter comprises a circular outer shear plate with a number of perforations and inner blades rotating about an center axis of the shear plate to sweep the inside surface thereof for shearing the hairs introduced through the perforations. The hair cutter also includes a comb member which is disposed around the outer shear plate in order to raise the hairs and feed them into the perforations. With this arrangement, it is readily possible even by the unskilled user to feed only the tips of the long hairs into the perforations for successfully trimming the long hairs. Nevertheless, the hair cutter poses another problem that only the half of the circular outer shear plate is effective for introducing the hairs and further that only a half of that effective area (i.e., a quarter of the entire plate) is effective for hair shearing when considering the rotating direction of the inner blade with respect to the outer shear plate. Therefore, a relatively long cutting time is required for trimming a unit amount of the hairs, which eventually results in increased amount of wearing that the outer and inner blades experience.

SUMMARY OF THE INVENTION

The above problems have been eliminated in the present invention which provides a novel hair cutter capable of effectively trimming the long hairs. The hair cutter in accordance with the present invention comprises a housing with a part-cylindrical cutter head and a comb member. The cutter head comprises an outer shear plate having a number of perforations and an inner cutter assembly. The inner cutter assembly includes a rotary shaft carrying a plurality of radially oriented cutter blades in a circumferentially spaced relation about an axis of the rotary shaft. The outer shear plate is arcuately curved in transverse cross section to cover a portion of a circle centered on the rotary shaft axis so as to have its inside surface in hair shearing engagement with the cutter blades. Included in the housing is a drive source which is connected to the rotary shaft for rotating the cutter blades in such a manner that the cutter blades sweep the inside surface of the outer shear plate for shearing hairs introduced through the perforations. The comb member has a number of comb teeth which are spaced along the rotary shaft axis and extend over an perforated area of the outer shear plate for smoothing the hairs into the perforations. The comb teeth are configured to have tapered ends for facilitating the hair smoothing into the perforations. With this arrangement, the outer shear plate can have an enlarged effective shearing zone extending over a wide area in the part-cylindrical cutting head, which assures efficient hair trimming in cooperation with the comb member smoothing the hairs into the perforations of the outer shear plate.

Accordingly, it is a primary object of the present invention to provide a hair cutter which is capable of efficiently and successfully performing the hair trimming with an increased effective shearing area and the hair smoothing comb member.

Preferably, the cutter head comprises a frame supporting the outer shear plate. The frame is arcuately curved into a part-cylindrical configuration to define two curved side surfaces on the opposite sides of an apex thereof. One side surface is formed with a opening which is elongated along the length of the apex and into which the outer shear plate is exposed. The other curved side surface defines a blind surface terminating in the apex. The comb member extends over the opening or the exposed outer shear plate in such a manner as to have their tapered ends extending over a portion of the blind surface past the apex. Thus, the outer shear plate can be exposed only in the one curved surface of the part-cylindrical configuration but over a wider area in that surface to have an enlarged effective shearing zone. Consequently, the remaining portion of the outer shear plate which is not available for the hair shearing can be concealed behind the other curved surface, i.e., the blind surface so that it can be protected from unexpected deformation. Further, due to the provision of the blind surface, the clipped hairs trapped inside of the outer shear plate can be well prevented from scattering outwardly from the cutter head.

It is therefore another object of the present invention to provide a hair cutter in which the outer shear plate can be protected from unexpected deformation as well as the clipped hairs can be prevented from scattering outwardly of the cutter head.

Further, the comb member is slidably mounted to the housing in order to vary a distance between the comb teeth and the outer shear plate, thereby adjusting the cutting length and/or cutting amounts of the hairs as required, which is therefore a further object of the present invention.

These and still other objects and advantages will become more apparent from the following description of the embodiment when taken in conjunction with the attached drawings.

DETAILED DESCRIPTION OF THE EMBODIMENT

Figure 1:
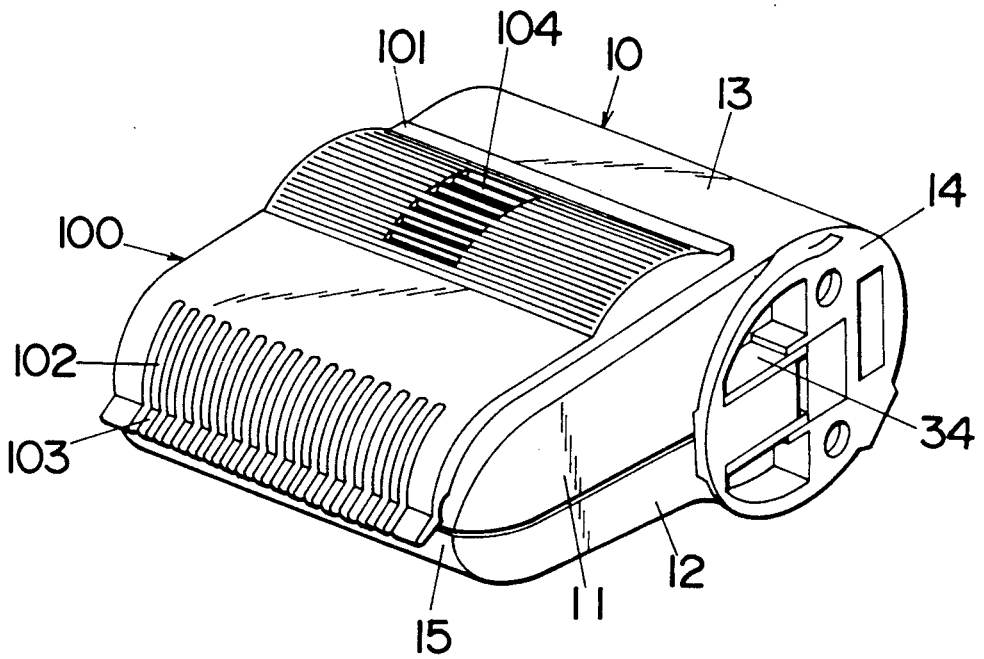
FIG. 1 is a perspective view of a hair cutter in accordance with a preferred embodiment of the present invention.
Figure 2:
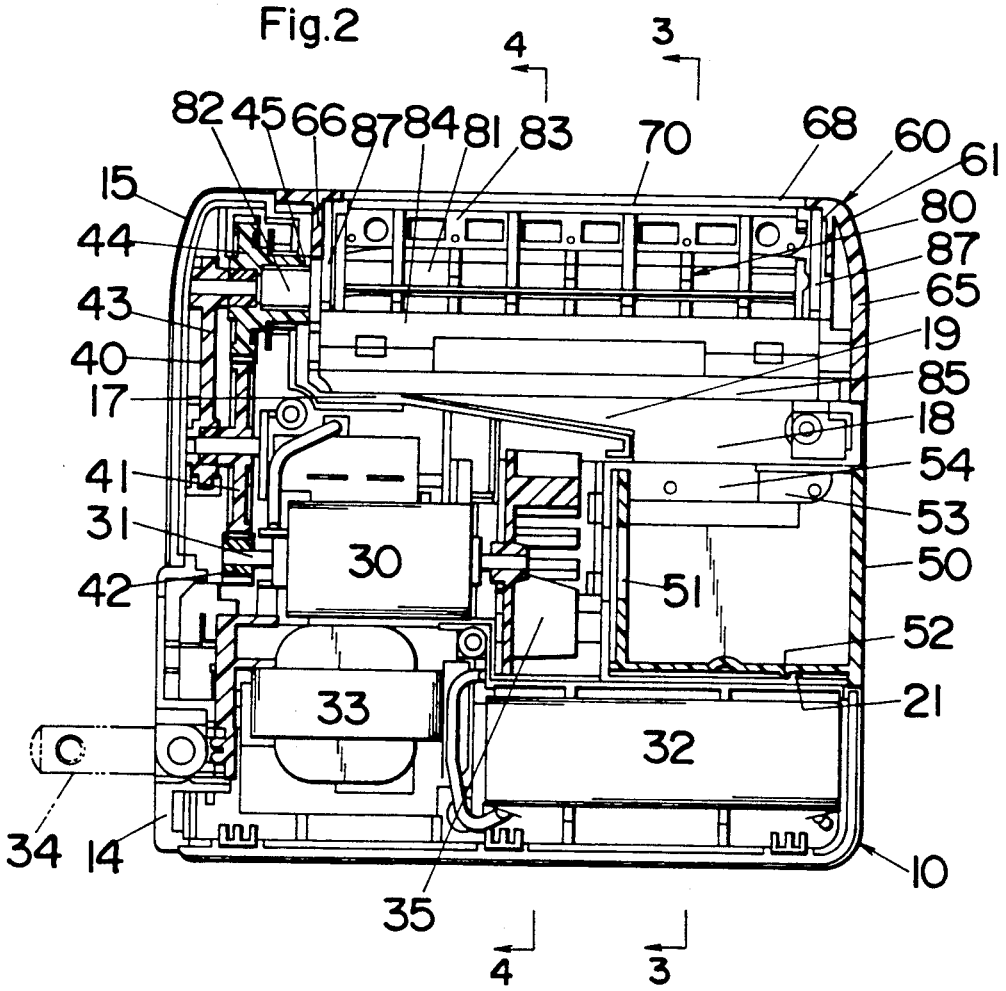
FIG. 2 is a vertical section of the hair cutter.
Figure 14:
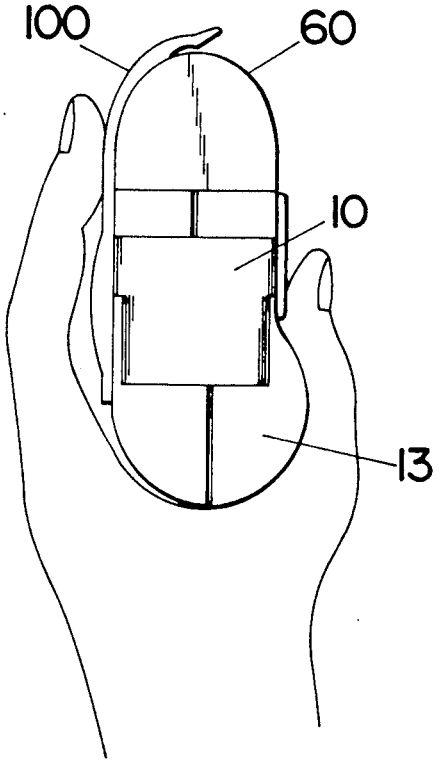
FIGS. 14 to 16 are views illustrating the manipulation of the hair cutter.
Figure 15:
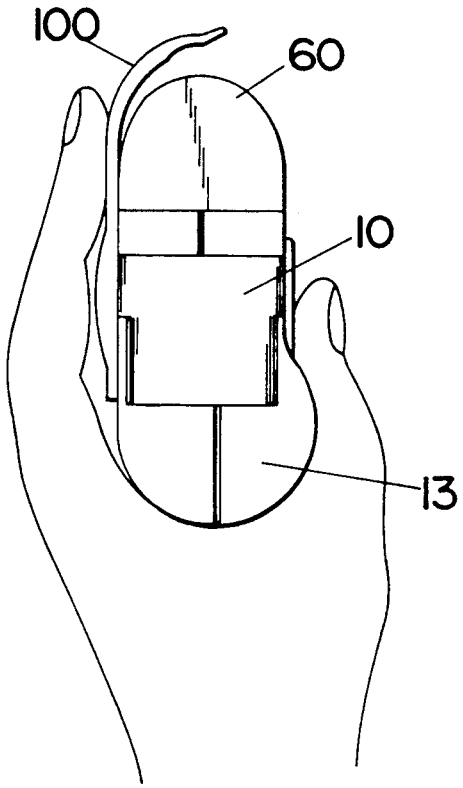

Referring now to FIGS. 1 to 7, a hair cutter in accordance with a preferred embodiment of the present invention is shown to comprise a housing 10 of a generally flat rectangular configuration, a part-cylindrical cutter head 60, and a comb member 100. The housing 10 is composed of two halves 11 and 12 of plastic material which are assembled together to accommodate therein an electric motor 30, a rechargeable battery 32, a transformer 33 forming a charging circuit for the battery 32. The housing 10 is shaped to have at its bottom a somewhat bulged portion 13 which is designed to smoothly fit into the palm when the housing 10 is gripped between the thumb and the other fingers of a user's hand, as shown in FIGS. 14 and 15. An upstanding end bracket 15 is formed to integrally projecting from one end on top of the housing 10. Projecting sideward from one end of the bulged portion 13 is a pair of prongs 34 to be connected to a conventional electric outlet for recharging the battery 32. The prongs 34 are pivotally supported to be folded into an end plate 14 of the bulged portion 13. The battery 32 and the transformer 33 are disposed within the bulged portion 13 in a tandem arrangement along the length thereof. The motor 30 has an output rotor shaft 31 extending on the both sides thereof for connection to a fan 35 at one end and to a reduction gear train 40 at the other end, as shown in FIG. 2. The reduction gear train 40 comprises a first gear 41 engaged with a pinion 42 on the motor shaft 31, an intermediate gear 43, and a drive gear 44 with a socket 45. The drive gear 44 is received within the end bracket 15 on top of the housing 10 with the socket 45 exposed and directed inwardly of the bracket 15.

Figure 3:
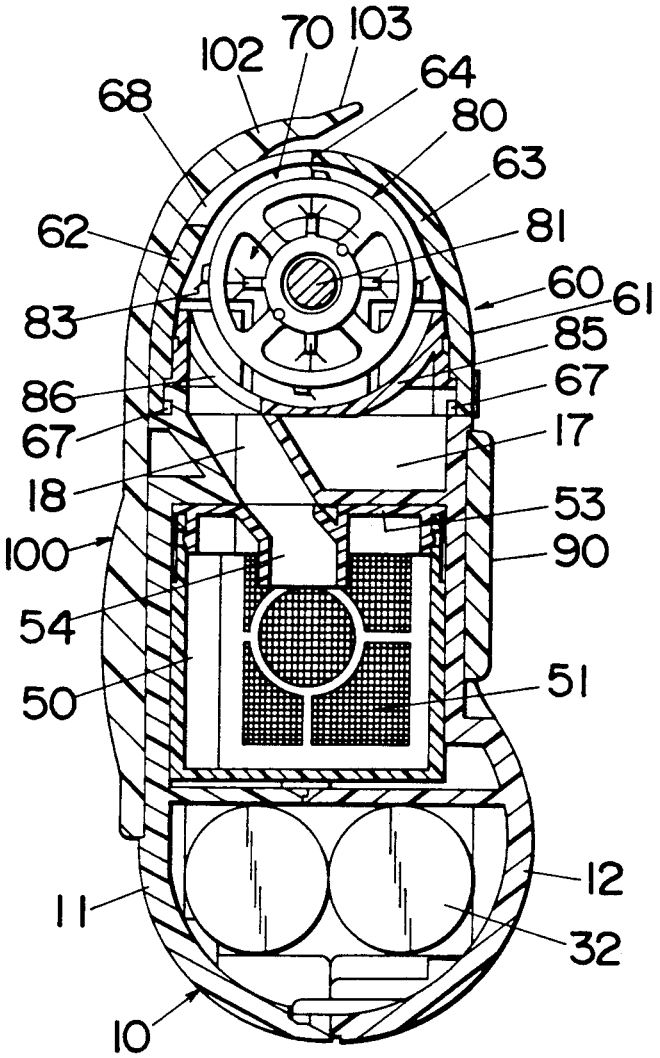
FIG. 3 is cross section taken along line 3—3 of FIG. 2.
Figure 4:
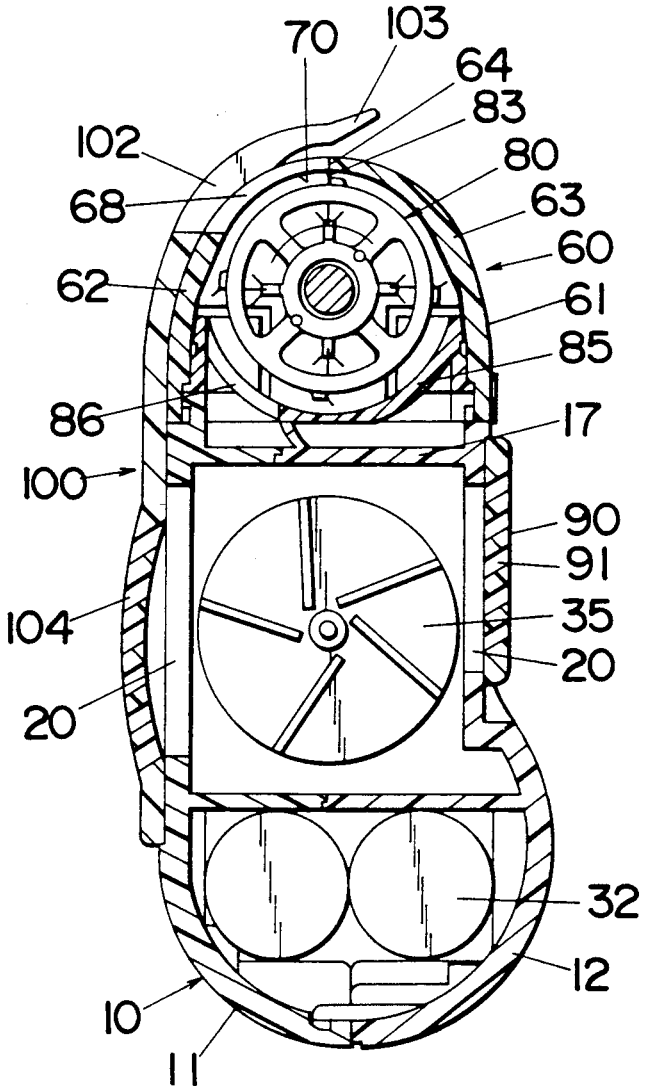
FIG. 4 is cross section taken along line 4—4 of FIG. 2.
Figure 5:
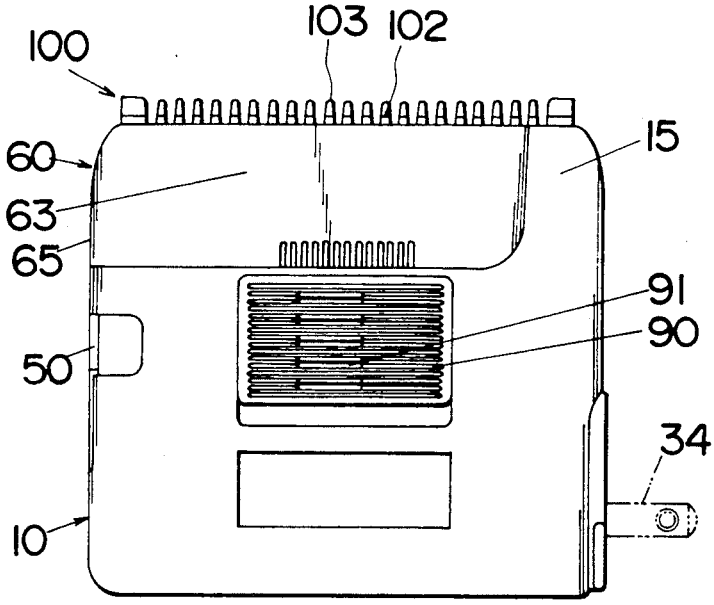
FIGS. 5 to 7 are rear, side and front views, respectively, of the hair cutter with a comb member shown in its lowered position.
Figure 6:
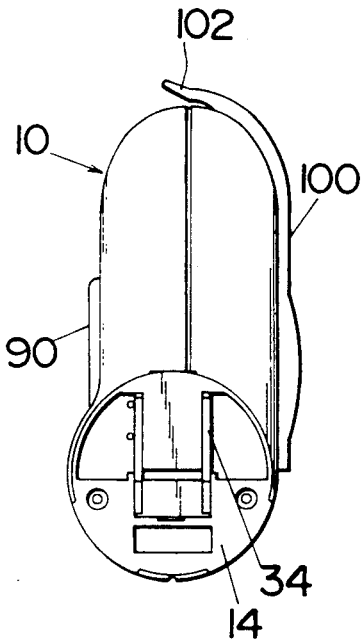
Figure 7:
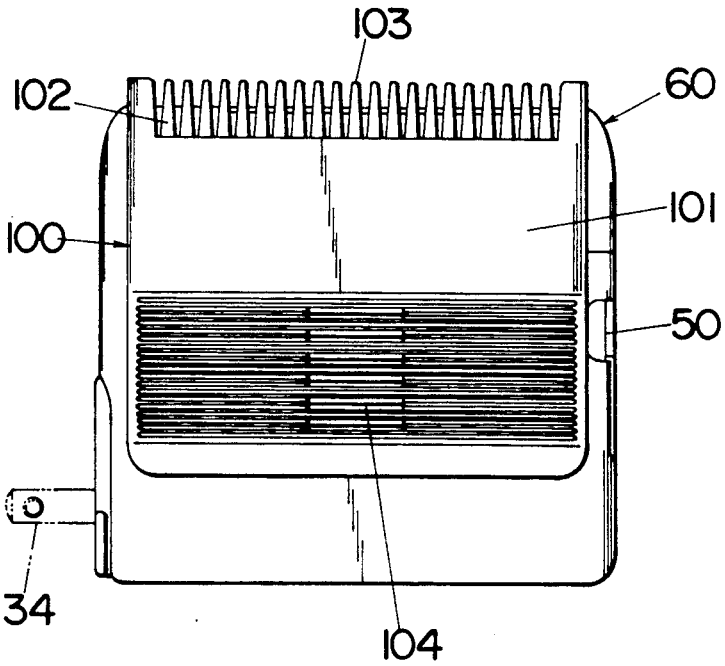
Figure 8:
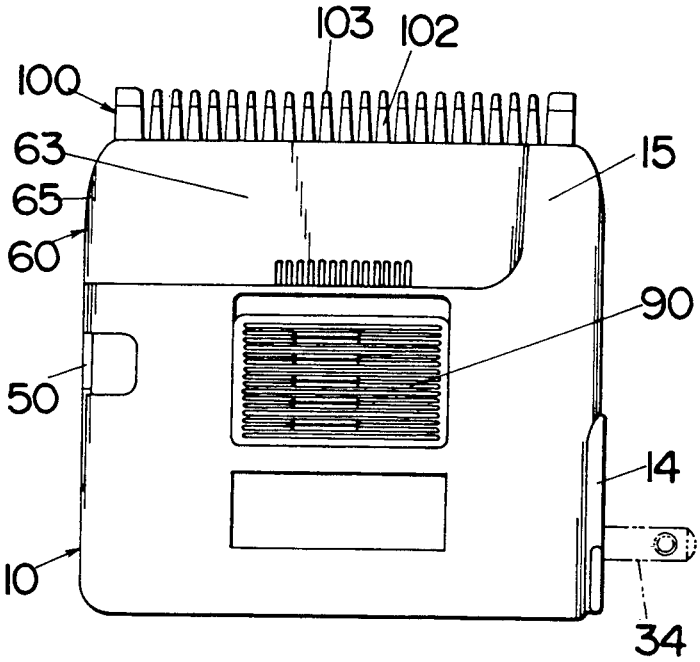
FIGS. 8 to 10 are rear, side and front views, respectively, of the hair cutter with the comb member shown in its upwardly extended position.
Figure 9:
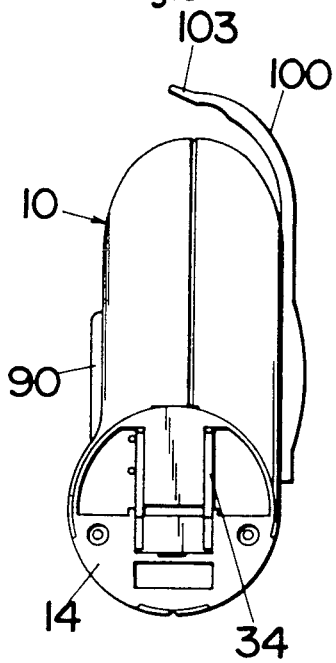
Figure 10:
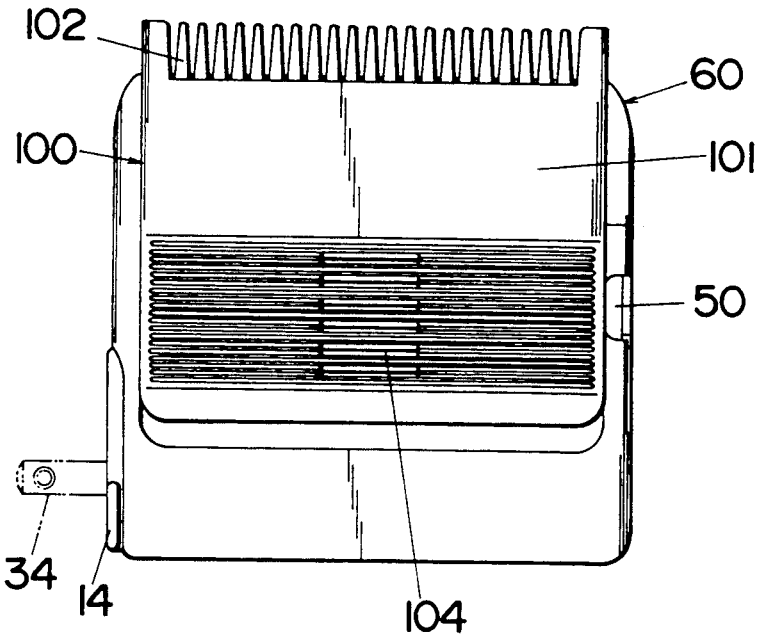

The cutter head 60 comprises a frame 61 carrying an outer shear plate 70 and an inner cutter assembly 80. The frame 61 is of a part-cylindrical configuration with two opposed curved side walls 62 and 63 on the opposite sides of an apex 64, which curved side walls are centered on a common center axis extending in parallel to the apex. Formed on the lower inner ends of the side walls 62 and 63 are a plurality of guide projections 67 which are slidably guided through corresponding grooves formed in the front and rear surfaces at the upper end of the housing 10, as shown in FIG. 3, so that the cutter head 60 can be slid horizontally onto and away from the top of the housing 10. The frame 61 also includes a pair of end walls 65 and 66. The end wall 65 forms an outer surface which is continuous with a corresponding end surface of the housing 10 when the cutter head 60 is attached to the housing 10. The other end wall 66 is recessed to receive therein a portion of the bracket 15 when the cutter head 60 is mounted on the housing 10, as shown in FIG. 2. The one side wall 62 is formed with an axially elongated opening 68 of which upper edge terminates approximately at the apex of the frame 61, as shown in FIGS. 3 and 4, so that only about a half of the outer shear plate 70 is exposed through the opening 68 and the other half is concealed behind the other side wall 63. The outer shear plate 70 is made of a rectangular flexible thin metal with a number of perforations and is flexed to conform to the curved inner surface of the frame 61 with its lateral sides hooked or secured to the lower ends of the side walls 62 and 63, respectively. Although not seen in the figures, the perforations are distributed over substantially the entire area of the shear plate 70 and are arranged in a plurality of rows inclined with respect to a longitudinal axis thereof.

The inner cutter assembly 80 comprises a rotary shaft 81 carrying a plurality of radially oriented cutter blades 83 extending over substantially the full length of the outer shear plate 70. Also included in the assembly 80 is a holder 84 with a bottom plate 85 and a pair of end flanges 87 integrally projecting upwardly from the opposed ends of the bottom plate 85. The rotary shaft 81 is journaled at its ends respectively in the end flanges 87 so that the cutter blades 83 are positioned between the end flanges 87 above the bottom plate 85. The one end of the rotary shaft 81 projecting outwardly of the end flange 87 is splined to form a coupling end 82 which is inserted into the socket 45 for driving connection to the motor 30 when the cutter head 60 is mounted on the housing 10. The holder 84 is snapped into the frame 61 so that the inner cutter assembly 80 can be attached and detached together with the frame 61 as a single unit to and from the housing 10. The rotary shaft 81 is aligned with the center axis of the outer shear plate 70 or the part-cylindrical frame 61 to rotate the cutter blades 83 along the inside circular surface of the outer shear plate 70. As shown in FIGS. 3 and 4, the bottom plate 85 of the holder 84 is arcuately curved along a circular path of the cutter blades 83 and is formed with an axially elongated slot 86 at a laterally offset location in vertically correspondence to the exposed portion of the outer shear plate 70. The cutter blade 83 are each spring biased to be urged against the inside surface of the outer shear plate 70 and are driven to rotate in the counterclockwise direction as seen in FIGS. 3 and 4, so that the blades 83 sweeps the circumference of the outer shear plate 70 from the blinded portion 63 to the adjacent exposed portion 68. Each of the blades 83 has its cutting edge bent in the rotating direction so as to effectively cut the hairs introduced through the perforations of the outer shear plate 70.

The upper end of the housing 10 is closed by a top wall 17 on which the bottom plate 85 of the holder 84 is seated when the cutter head 60 is mounted thereon. The top wall 17 is formed therein with a passage 18 of which upper end is widened to define a funnel 19 for registration with the slot 86 in the bottom plate 85, as shown in FIG. 2. The passage 18 extends downwardly in an inclined fashion, as shown in FIG. 3, to a clipped hair collector 50 for feeding the clipped hairs thereto. The passage 18 has a cross-section which is somewhat narrower towards the collector 50. The fan 35 is disposed adjacent the collector 50 to produce a forced air flow carrying the clipped hairs from within the cutter head 60 through the passage 18 into the collector 50. The collector 50 is formed to have a screen or filter 51 in one end wall so that the forced air flow can pass through the filter 51 while the clipped hairs carried thereon can be entrapped within the collector 50, permitting the air flow to escape outwardly of the housing 10 through apertures 20 in the front and rear surfaces of the housing 10 and through vents 91 and 104 formed respectively in a switch handle 90 and the comb member 100. The collector 50 is detachably received within the housing 10 with a click projection 52 engaged with a corresponding notch 21 in the housing 10, as shown in FIG. 2, so as not to be accidentally slipped out of the housing 10. The collector 50 can be pulled out of the housing 10 from time to time for disposal of the accumulated clipped hairs therein. To this end, the collector 50 has a removable lid 53 to empty out the clipped hairs, the lid 53 being provided with an intake channel 54 which communicates with the passage 18 when attached into the housing 10. It is noted at this time that an approximately half of the outer shear plate 70 is concealed within the frame 61 such that the clipped hairs can be prevented from flowing outwardly of the cutter head 60, which would otherwise be likely if the outer shear plate 70 is exposed also at that half portion which does not come into a opposed relation to the head of the user. Thus, the clipped hairs can be successfully recovered as being carried on the forced air flow into the collector 50 without being flown outwardly from the cutter head 60. The switch handle 90 is slidably mounted on the rear face of the housing 10 to be readily manipulated by the thumb of the user holding the hair cutter between an ON position of energizing the motor 30 and an OFF position of deenergizing the same.

Attached to the front face of the housing 10 is the comb member 100 which comprises a generally flat plate 101 extending over substantially the full width of the housing 10 and a number of comb teeth 102 integrally projecting from the upper end of the plate 101 and spaced along the axis of the cutter head 60 to cover the full length of the outer shear plate 70. The comb teeth 102 are bent along the curved outer shear plate 70 to extend past the apex of the cutter head 60 and terminate in tapered ends 103 in juxtaposed relation to the apex, as shown FIGS. 3 and 4. The tapered ends 103 are defined by the narrowing thickness of the teeth 102 towards the distal ends and are somewhat inclined upwardly away from the apex for facilitating to seize the hairs between the comb teeth 102.

Figure 11:
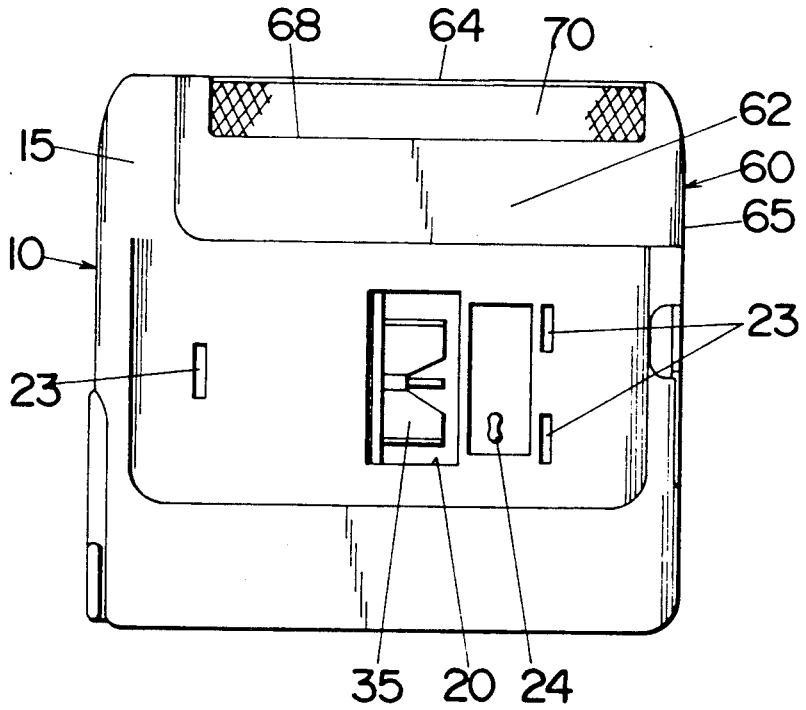
FIG. 11 is a front view of the hair cutter with the comb member removed therefrom.
Figure 12:
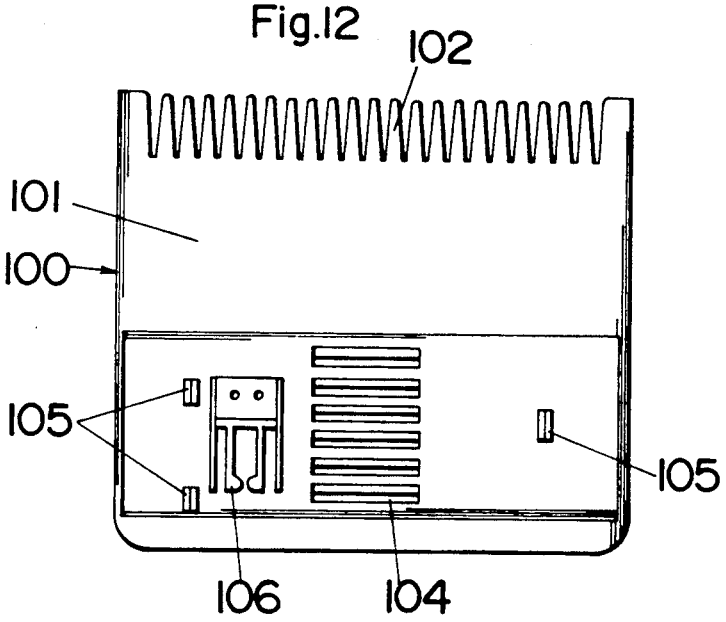
FIG. 12 is a rear view of the comb member.
Figure 13:
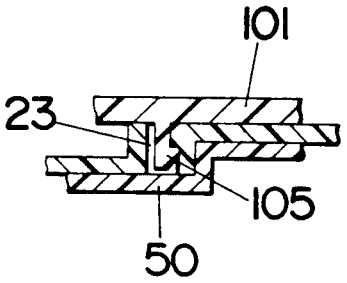
FIG. 13 is a partial sectional view illustrating the connection of the comb member to a hair cutter housing.
Figure 16:
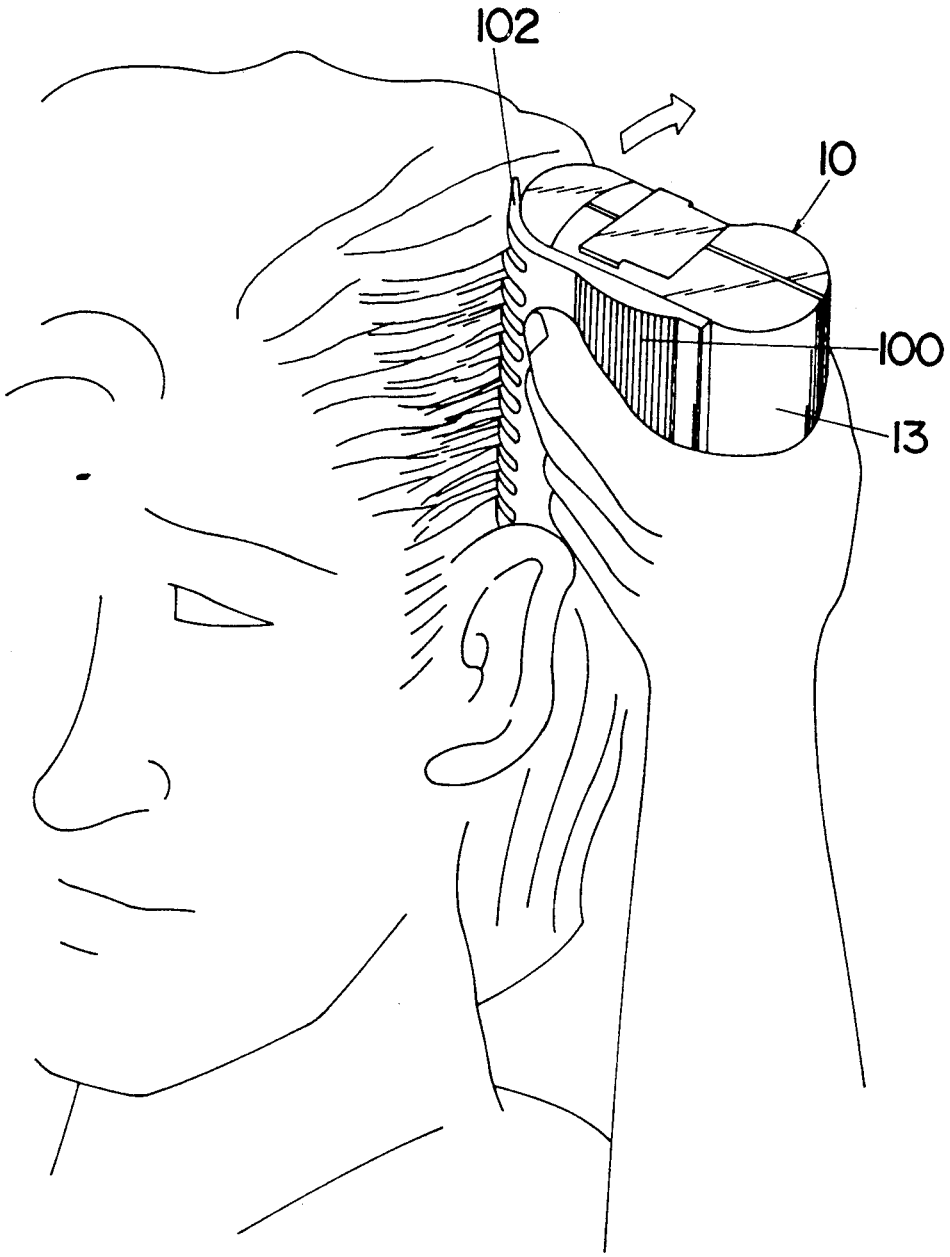
Figure 17:
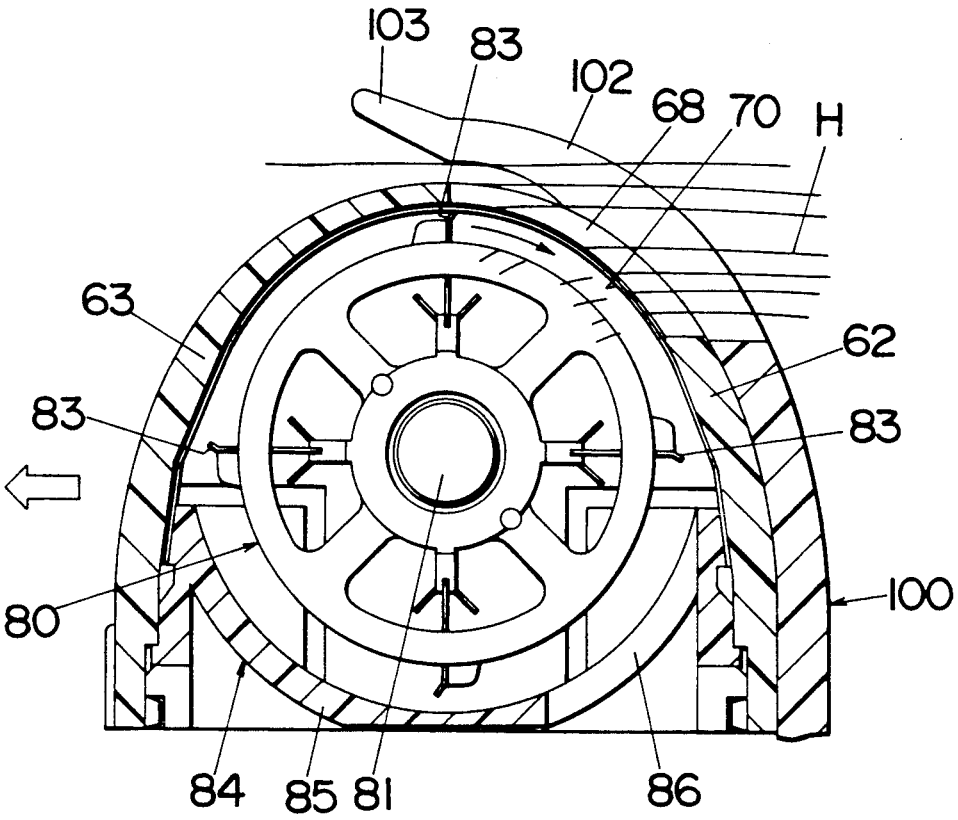
FIG. 17 is a sectional view illustrating the hair cutting mechanism of the hair cutter.

In operation, the hair cutter is manipulated to advance along the streams of the hairs in such a manner as to smooth the hairs H with the exposed outer shear foil 70 positioned rearwardly with respect to the advancing direction, as shown in FIGS. 16 and 17. As the hairs are being smoothed out, the tips of the hairs are raised and fed into the perforations of the outer shear plate 70 so as to be cut by the cooperation of the rotating cutter blades 83 and the outer shear plate 70, thus effecting the trimming of relatively long hairs. The comb member 100 is vertically slidable to vary the distance between the comb teeth 102 and the outer shear plate 70 whereby adjusting the cutting length and/or the cutting amount of the hairs. As shown in FIGS. 11 to 13, the comb member 100 is formed with hooks 105 which extend into vertical slits 23 to be slidable engaged therewith and also formed with resilient legs 106 which come into clicking engagement with a cam projection 24 on the housing 10 such that the comb member 100 is clicked into three vertical positions for the above adjustment of the hair cutting. The slits 23 are closed within the housing 10 by a suitable member or the part of the collector 50, as shown in FIG. 13, in order to prevent the entry of the clipped hairs into the housing 10 through the slits 23. The comb member 100 and the switch handle 90 are knurled on their respective outer surface to facilitate manual operation by the fingers of the user.

What is claimed is:

1. A hair cutter comprising:

a housing with a cutter head comprising an outer shear plate having a number of perforations and an inner cutter assembly; said inner cutter assembly having a rotary shaft and a plurality of radially oriented cutter blades supported thereon in a circumferentially spaced relation about an axis of said rotary shaft, said outer shear plate being arcuately curved in transverse cross section around a portion of a circle centered on said rotary shaft axis so as to have its inside surface in hair shearing engagement with said cutter blades, drive means mounted in said housing for rotating said inner cutter assembly in such a manner that said cutter blades sweep the inside surface of said outer shear plate to shear hairs introduced through said perforations; and a comb member attached to said housing and having a number of comb teeth spaced along the axis of said rotary shaft and extending over an perforated area of said outer shear plate for smoothing the hairs into said perforations, said comb teeth being configured to have tapered ends.

2. A hair cutter as set forth in claim 1, wherein said cutter head comprises a frame supporting said outer shear plate, said frame being arcuately curved into a part-cylindrical configuration to define two curved side surfaces on the opposite sides of an apex thereof, one of said side surfaces having an opening which is elongated along the length of said apex and into which said outer shear plate is exposed while the other side surface defining a blind surface extending to said apex, and said comb member extending over said opening to have said tapered ends extending over a portion of said blind surface past said apex.

3. A hair cutter as set forth in claim 1, wherein said comb member is slidably mounted to said housing so as to vary the distance between the comb teeth and the outer shear plate.

* * * * *